US010183315B2

(12) United States Patent
Ma et al.

(10) Patent No.: US 10,183,315 B2
(45) Date of Patent: Jan. 22, 2019

(54) SUBSTRATE CLEANING DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Qingqing Ma, Beijing (CN); Zhi Hou, Beijing (CN); Daeoh Oh, Beijing (CN); Ziheng Yang, Beijing (CN); Hongbo Zhang, Beijing (CN); Baiqiang Wang, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 263 days.

(21) Appl. No.: 14/381,505

(22) PCT Filed: Oct. 15, 2013

(86) PCT No.: PCT/CN2013/085214
§ 371 (c)(1),
(2) Date: Aug. 27, 2014

(87) PCT Pub. No.: WO2015/003433
PCT Pub. Date: Jan. 15, 2015

(65) Prior Publication Data

US 2016/0250670 A1 Sep. 1, 2016

(30) Foreign Application Priority Data

Jul. 12, 2013 (CN) ..... 2013 1 0293522

(51) Int. Cl.
*B08B 3/02* (2006.01)

(52) U.S. Cl.
CPC ..... *B08B 3/024* (2013.01); *B08B 3/022* (2013.01)

(58) Field of Classification Search
CPC ..... B08B 3/022
See application file for complete search history.

(56) References Cited

FOREIGN PATENT DOCUMENTS

CN 1307054 A 8/2001
CN 1684235 A 10/2005
(Continued)

OTHER PUBLICATIONS

KR10-0962520, Hyeon, Dec. 2009, English machine translation, publication equivalent of CN101604621.*
(Continued)

*Primary Examiner* — Jason Y Ko
(74) *Attorney, Agent, or Firm* — Ladas & Parry LLP

(57) ABSTRACT

A substrate cleaning device includes: a housing having a cleaning chamber therein; a plurality of spray pipelines pivotally mounted at the housing and distributed side by side along a moving direction of a substrate, each of the spray pipelines is provided with several spray ports configured to direct liquid in the spray pipeline towards a surface to be cleaned of the substrate, and one end of each of the spray pipelines is provided with a transmission gear coaxially fixed thereto; a driving system (4) coupled with the transmission gear and thus configured to drive the spray pipeline, through the transmission gear, to rotate reciprocally at the same frequency, wherein a portion of spray pipelines have a reciprocal rotation direction opposite to that of the other portion of spray pipelines. This substrate cleaning device enables a better cleaning effect for the substrate surface with minimum influence on the traveling speed of the substrate.

17 Claims, 3 Drawing Sheets

(56) References Cited

FOREIGN PATENT DOCUMENTS

| | | | |
|---|---|---|---|
| CN | 101604621 | A | 12/2009 |
| CN | 103316862 | A | 9/2013 |

OTHER PUBLICATIONS

Second Chinese Office Action Appln. No. 2013103293522.0; dated Mar. 9, 2015.
Written Opinion of the International Searching Authority dated Apr. 1, 2014; PCT/CN2013/085214.
International Search Report Appln. No. PCT/CN2013/085214; dated Apr. 28, 2013.
First Chinese Office Action Appln. No. 201310293522.0; dated Aug. 26, 2014.

* cited by examiner

SUBSTRATE CLEANING DEVICE

TECHNICAL FILED

Embodiments of the present invention relate to a substrate cleaning device.

BACKGROUND

Cleaning is a very important process during the manufacture of a substrate used for a flat panel display. The cleaning effect directly influences the product quality of a substrate whether it's before conducting a film-plating process on the substrate or after completing the manufacture process of the substrate.

Existing substrate cleaning devices mostly adopt immovable spray pipelines which are provided with spray nozzles facing towards a substrate, and when cleaning the substrate the spray nozzles spray liquid within the spray pipelines towards a substrate surface in a direction perpendicular to the substrate so as to clean a surface to be cleaned of the substrate. However, such a cleaning manner can only spray a small amount of liquid directly into channels, grooves or slits formed in the substrate surface and thus provides an inferior cleaning effect for impurities remaining within the channels, the grooves or the slits of the substrate, thereby influencing a cleaning effect of the entire substrate.

SUMMARY

Embodiments of the present invention provide a substrate cleaning device which improves the cleaning effect of the substrate surface with minimum influence on a traveling speed of the substrate.

One aspect of the present invention provides a substrate cleaning device, comprising: a housing having a cleaning chamber therein; a plurality of spray pipelines pivotally mounted at the housing and distributed side by side along a moving direction of a substrate, each of the spray pipelines is provided with several spray ports which are configured to direct liquid in the spray pipelines towards a surface to be cleaned of the substrate, and one end of each of the spray pipelines is provided with a transmission gear coaxially fixed thereto; a driving system coupled with the transmission gear so as to drive the spray pipelines, through the transmission gear, to rotate reciprocally at the same frequency, wherein a portion of spray pipelines have a reciprocal rotation direction opposite to that of the other portion of spray pipelines.

When the substrate cleaning device as provided by embodiments of the present invention is used for cleaning a surface to be cleaned of the substrate, liquid is continuously injected into the spray pipelines through external feeding conduits, and the liquid within the spray pipelines is sprayed towards the substrate surface through the spray ports. Since all the spray pipelines are rotating axially and reciprocally at the same frequency so that the liquid continuously sprayed from the spray ports is swinging reciprocally, an angle between a spray direction of the liquid from the spray ports and the substrate is alternating regularly, thereby ensuring more liquid be directly sprayed into the channels, grooves or slits in the substrate surface and thus improving the cleaning effect for impurities remaining within the channels, grooves or slits in the substrate surface.

In addition, the two portions of spray pipelines are rotating reciprocally in opposite directions, which allows the liquid that is continuously sprayed from the spray ports on the two portions of spray pipelines to swing reciprocally in opposite directions, thus the liquid in the two portions of spray pipelines rotating in opposite directions is sprayed out of the spray ports in opposite directions; the liquid that is sprayed in opposite directions provides a pushing effect and a blocking effect which are counteracting with each other for a travelling motion of the substrate, thereby decreasing an influence on a travelling speed of the substrate on a transportation apparatus resulted by an impact of the liquid. Hence, the substrate cleaning device as provided by the present invention enables a better cleaning effect for the substrate surface with minimum influence on the traveling speed of the substrate.

BRIEF DESCRIPTION OF THE DRAWINGS

Embodiments of the present invention will be described in more details below with reference to the accompanying drawings to enable those skilled in the art to understand the present invention more clearly, wherein.

DETAILED DESCRIPTION

In order to make objects, technical details and advantages of the embodiments of the invention apparent, technical solutions according to the embodiments of the present invention will be described clearly and completely as below in conjunction with the accompanying drawings of embodiments of the present invention. It is to be understood that the described embodiments are only a part of but not all of exemplary embodiments of the present invention. Based on the described embodiments of the present invention, various other embodiments can be obtained by those of ordinary skill in the art without creative labor and those embodiments shall fall into the protection scope of the present invention.

Unless otherwise defined, all the technical and scientific terms used herein have the same meanings as commonly understood by one of ordinary skill in the art to which the present invention belongs. The terms, such as "first," "second," or the like, which are used in the description and the claims of the present application, are not intended to indicate any sequence, number or importance, but for distinguishing various components. Also, the terms, such as "a/an," "one," or the like, are not intended to limit the amount, but for indicating the existence of at lease one. The terms, such as "comprise/comprising," "include/including," or the like are intended to specify that the elements or the objects stated before these terms encompass the elements or the objects and equivalents thereof listed after these terms, but not preclude other elements or objects. The terms, "on," "under," or the like are only used to indicate relative position relationship, and when the position of the object which is described is changed, the relative position relationship may be changed accordingly.

Figure 1:
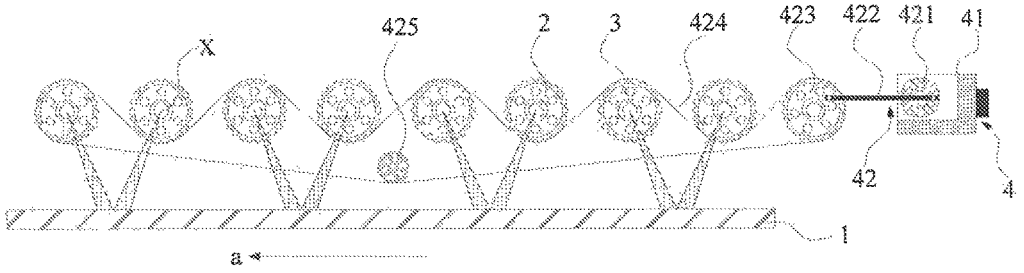
FIG. 1 is a schematic view illustrating a winding direction of a conveyer belt of a first type of transmission mechanism in a substrate cleaning device as provided by the first embodiment of the present invention.
Figure 2:
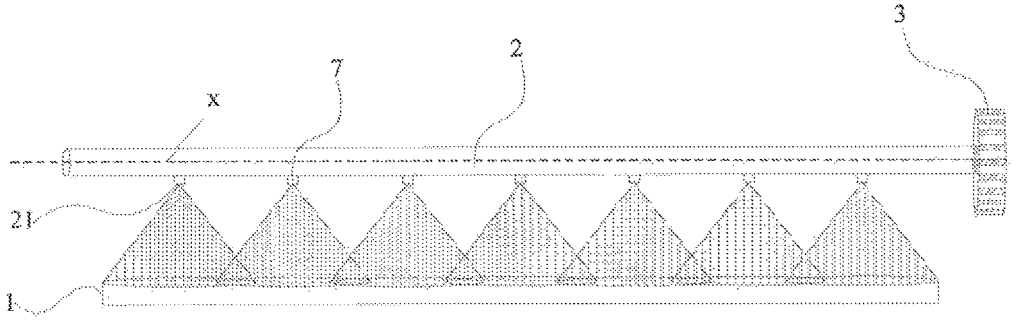
FIG. 2 is a schematic view illustrating a mechanism of spray pipelines in a substrate cleaning device as provided by the first embodiment of the present invention.

Referring to FIG. 1 and FIG. 2, the first embodiment of the present invention provides a substrate cleaning device comprising: a housing having a cleaning chamber therein; a plurality of spray pipelines 2 pivotally mounted at the housing and distributed side by side along a moving direction a of the substrate 1, each of the spray pipelines 2 is provided with several spray ports 21 configured to direct liquid within the spray pipeline 2 towards a surface to be cleaned of the substrate 1, and one end of each of the spray pipelines 2 is provided with a transmission gear 3 coaxially fixed thereto; a driving system 4 driving the spray pipelines 2, through the transmission gear 3, to rotate reciprocally at the same frequency, wherein a portion of spray pipelines 2 have a reciprocal rotation direction opposite to that of the other portion of spray pipelines 2. Each of the spray pipelines 2 is pivotally rotatable about a respective longitudinal axis x, and the longitudinal axis x of each of the spray pipelines 2 is perpendicular to the moving direction of the substrate.

When the driving system 4 is started, it drives a portion of transmission gears 3 to rotate axially and reciprocally in such a manner that they rotate anticlockwise firstly and then clockwise, and drives the spray pipelines 2 coaxially fixed to each one of this portion of transmission gears 3 to rotate axially and reciprocally in such a manner that they rotate anticlockwise firstly and then clockwise; and at the same time, the driving system 4 also drives the other portion of transmission gears 3 to rotate axially and reciprocally in such a manner that they rotate clockwise firstly and then anticlockwise, so as to drive the other portion of spray pipelines 2 to rotate axially and reciprocally in such a manner that they rotate clockwise firstly and then anticlockwise. The two portions of transmission gears 3 are all rotating axially and reciprocally at the same frequency.

When the substrate cleaning device as provided by the embodiment is used for cleaning a surface to be cleaned of the substrate 1, the spray pipelines 2 communicate with external feeding conduits (not shown) such that the external feeding conduits inject a cleaning liquid continuously into the spray pipelines 2. The liquid within the spray pipelines 2 is sprayed towards a surface of the substrate 1 disposed below through the spray ports 21. Respective spray pipelines 2, while rotating axially and reciprocally at the same frequency, drive the liquid that is continuously sprayed from the spray ports 21 to swing reciprocally, so that an angle between a spray direction of the liquid from the spray ports 21 and the substrate 1 is alternating regularly, thereby ensuring more liquid be directly sprayed into channels, grooves or slits formed in the surface of the substrate 1 and thus improving the cleaning effect for impurities remaining within the channels, grooves or slits in the surface of the substrate 1.

In addition, the two portions of spray pipelines 2 are rotating reciprocally in opposite directions, which allows the liquid that is continuously sprayed from the spray ports 21 on the two portions of spray pipelines 2 to swing reciprocally in opposite directions, thus the liquid from the two portions of spray pipelines 2 rotating in opposite directions is sprayed out of the spray ports 21 in opposite directions; the liquid that is sprayed in opposite directions provides a pushing effect and a blocking effect which are counteracting with each other for the traveling motion of the substrates 1, thereby decreasing the influence on a travelling speed of the substrate 1 on the transportation apparatus resulted by an impact of the liquid.

Hence, the substrate cleaning device as provided by the embodiment enables a better cleaning effect for the substrate surface with minimum influence on the travelling speed of the substrate.

For example, the two portions of spray pipelines 2 rotating reciprocally in opposite directions are arranged at the same amount; for example, the spray ports 21 on the two portions of spray pipelines 2 are arranged at the same amount, and disposed to be opposite to each other or offset from each other.

As such, on any occasion, when the liquid sprayed from the spray ports 21 on the two portions of spray pipelines 2 is acting on the substrate 1, a pushing effect and a blocking effect for the travelling motion of the substrate produced by the liquid are counteracting with each other exactly and entirely, so that the influence on the travelling speed of the substrate 1 on the transportation apparatus resulted by the impact of the liquid is reduced at an even greater extent.

Figure 3:
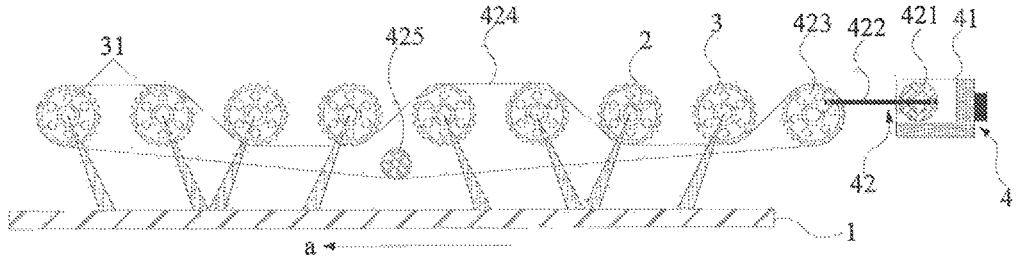
FIG. 3 is a schematic view illustrating another winding direction of the conveyer belt of the first type of transmission mechanism in the substrate cleaning device as provided by the first embodiment of the present invention.

FIG. 3 shows a substrate cleaning device as provided by a variation of the first embodiment of the present invention, with the only difference from the embodiment shown in FIG. 1 that the arrangement of the driving system 4 slightly varies.

Referring to FIG. 1 and FIG. 3, for example, the driving system 4 of the substrate cleaning device as provided by the embodiment of the present invention comprises: a drive motor 41; and a transmission mechanism 42 configured to drive a plurality of transmission gears 3 to rotate reciprocally, wherein a power input end of the transmission mechanism 42 is transmissively coupled with an output shaft of the drive motor 41.

The drive motor 41 serves as a power output device, of which the output shaft transmits the power to individual transmission gears 3 through the transmission mechanism 42, and drives individual transmission gears 3, through the transmission mechanism 42, to achieve axially reciprocal motion.

Referring to FIG. 1 and FIG. 3, for example, the transmission mechanism 42 comprises: a driving wheel 421 coaxially fixed at the output shaft of the drive motor 41; a connecting rod 422 having one end hinged with the driving wheel 421; a transition gear 423 hinged with the other end of the connecting rod 422, wherein the driving wheel 421, the connecting rod 422 and the transition gear 423 form a four-bar mechanism; a conveyer belt 424 connected with the plurality of transmission gears 3 and the transition gears 423; and at least one tensioning pulley 425 configured to tension the conveyer belt 424.

Two ends of the connecting rod 422, respectively, are rotatably connected with one pin shaft (not shown in the drawings) perpendicular to the connecting rod 422. The pin shaft at one end of the connecting rod 422 is fixed onto the driving wheel 421 and the pin shaft at the other end is fixed onto the transition gear 423 so that the connecting rod 422 is hinged between the driving wheel 421 and the transition gear 423, thereby forming a four-bar mechanism by the driving wheel 421, the connecting rod 422 and the transition gear 423. Through the four-bar mechanism, the drive motor 41 drives the transition gear 423 to rotate axially and reciprocally within a certain angular region, thereby driving the conveyer belt 424 coupled with the transition gear 423 to make reciprocal motion; the conveyer belt 424, while making reciprocal motion, drives individual transmission gears 3 coupled therewith to rotate axially and reciprocally. The spray pipeline 2 axially fixed with each of the transmission gears 3 rotates reciprocally along with the transmission gear 3, so as to drive the liquid that is sprayed continuously from the spray ports 21 on the spray pipeline 2 to swing reciprocally, and allow the angle between the spraying direction of the liquid from the spray ports 21 and the substrate 1 disposed below to vary regularly, thereby improving the cleaning effect of the substrate cleaning device for the substrate surface and decreasing the influence on the travelling speed of the substrate resulted by the liquid.

In addition, by alternating the winding direction of the conveyer belt 424 at respective transmission gears 3, it's possible to regulate the reciprocal rotation direction of individual transmission gears 3, so as to vary the reciprocal rotation direction of the spray pipelines 2.

Referring to FIG. 1 and FIG. 3 again, for example, a plurality of transmission gears 3 form several gear sets 31 which are adjacent to each other successively, and the conveyer belts 424 on the transmission gears 3 of any adjacent two gear sets 31 are winded in opposite directions.

Through a four-bar mechanism formed by the driving wheel 421, the connecting rod 422 and the conveyer belt 424, the drive motor 41 drives the conveyer belt 424 to make reciprocal motion; the conveyer belt 424, while making reciprocal motion, drives the transmission gear 3 to rotate axially and reciprocally. When the conveyer belt 424 moves in a direction, the transmission gears 3 on which the conveyer belts 424 are winded in opposite directions rotate in opposite directions such that the spray pipelines 2 driven by the transmission gears 3 rotating in opposite directions also rotate in opposite directions, which allows the liquid within the two portions of spray pipelines 2 rotating in opposite directions to be sprayed from the spray ports 21 in opposite directions; the liquid sprayed in opposite directions provides a pushing effect and a blocking effect which are counteracting with each other for the substrate, thereby decreasing the influence on the travelling speed of the substrate 1 on the transportation apparatus resulted by the impact of the liquid.

Referring to FIG. 1 and FIG. 3 again, for example, each of the above-mentioned gear sets 31 comprises at least one transmission gear 3.

More specifically, as shown in FIG. 1, each of the above-mentioned gear sets 31 comprises one transmission gear 3, and the conveyer belts 424 on any adjacent two transmission gears 3 are winded in opposite directions. As shown in FIG. 3, each of the above-mentioned gear sets 31 comprises two transmission gears 3, and the conveyer belts 424 on the two transmission gears 3 of the same gear set 31 are winded in the same direction, while the conveyer belts 424 on the transmission gears 3 of any adjacent two gear sets 31 are winded in opposite directions.

Figure 4:
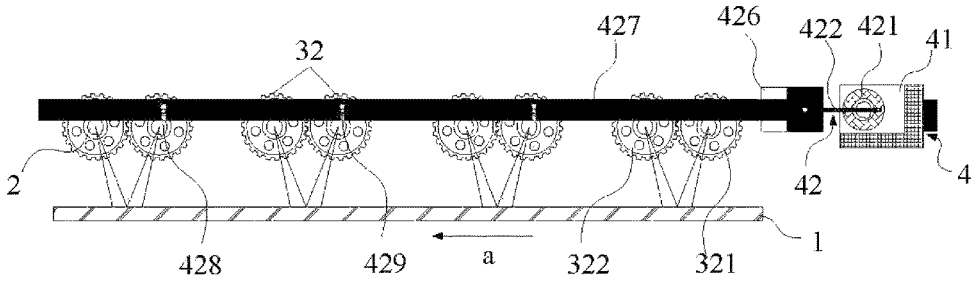
FIG. 4 is a schematic view showing a structure of a second type of transmission mechanism in a substrate cleaning device as provided by the second embodiment of the present invention.
Figure 5:
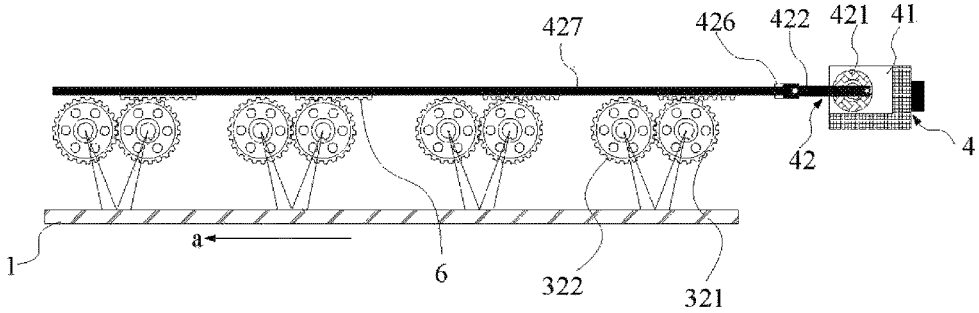
FIG. 5 is a schematic view showing a structure of a third type of transmission mechanism in a substrate cleaning device as provided by the third embodiment of the present application.
Figure 7:
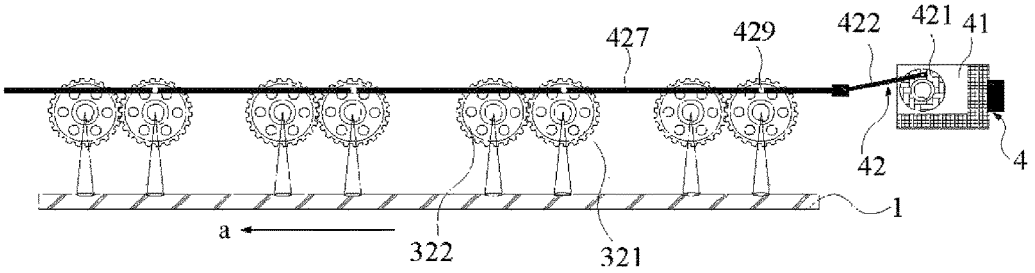
FIG. 7 is a schematic view showing a structure a fourth type of transmission mechanism in a substrate cleaning device as provided by the fourth embodiment of the present invention.

FIG. 4 is a schematic view showing a structure of a second type of transmission mechanism in a substrate cleaning device as provided by the second embodiment of the present invention. FIG. 5 is a schematic view showing a structure of a third type of transmission mechanism in a substrate cleaning device as provided by the third embodiment of the present invention. FIG. 7 is a schematic view showing a structure of a fourth type of transmission mechanism in the substrate cleaning device as provided by the fourth embodiment of the present invention. Referring to FIG. 4, FIG. 5 and FIG. 7, a plurality of transmission gears 3 form several gear sets 32 each comprising two transmission gears engaged with each other.

As shown in FIG. 4 and FIG. 5, gears 321 and 322 in the gear set 32 engage with each other. The transmission mechanism 42 comprises: a driving wheel 421, a connecting rod 422, a sliding rail 426 and a pushing bar 427 that form a crank slider mechanism; and a transform mechanism configured to connect the pushing bar 427 with one of the transmission gears 3 in each of the gear sets 32 and transform a linear motion of the pushing bar 427 into a circumferential motion of the transmission gear 3. The driving wheel 421 is coaxially fixed at the output shaft of the drive motor 41; one end of the connecting rod 422 is hinged with the driving wheel 421, and the other end of the connecting rod 422 is hinged with one end of the pushing bar 427; the sliding rail 426 is fixed relative to the housing and extending along the moving direction a of the substrate 1; the pushing bar 427 is slidably fitted at the sliding rail 426.

Two ends of the connecting rod 422, respectively, are rotatably connected with one pin shaft perpendicular to the connecting rod 422, wherein the pin shaft at one end of the connecting rod 422 is fixed onto the driving wheel 421 and the pin shaft at the other end of the connecting rod 422 is fixed at one end of the pushing bar 427 so that the connecting rod 422 is hinged between the driving wheel 421 and the pushing bar 427; the pushing bar 427 is slidably disposed in the sliding rail 426, which allows the driving wheel 421, the connecting rod 422 and the transition gear 423 to form a crank slider mechanism. The drive motor 41 drives the pushing bar 427, through the crank slider mechanism, to make linear motion reciprocally in the sliding rail 426; the pushing bar 427 drives one transmission gear 321 of the gear set 32, through the transforming mechanism, to rotate axially and reciprocally; the transmission gear 321 and the transmission gear 322 in the same gear set 32 engage with each other, thus they rotate reciprocally at the same frequency together in opposite directions such that a linear motion of the pushing bar 427 is transformed into a circumferential motion of the transmission gear 321. The spray pipelines 2, with which the transmission gear 321 and the transmission gear 322 of any of the gear sets 32 are connected, are rotating reciprocally in opposite directions, so that the two portions of spray pipelines 2 rotating reciprocally in opposite directions are arranged at the same amount, thereby reducing the influence on the travelling speed of the substrate 1 on the transportation apparatus resulted by the impact of the liquid at an even greater extent.

Figure 6:
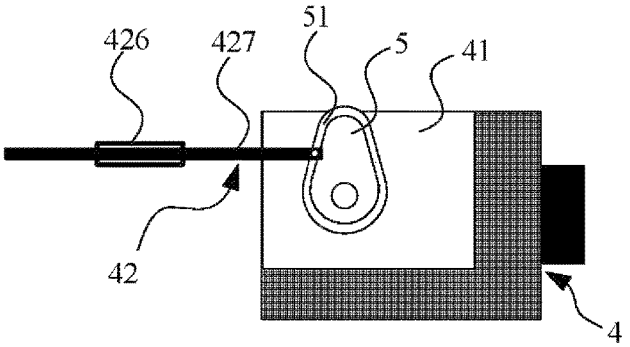
FIG. 6 is a schematic view illustrating a driving principle for another type of driving system in a substrate cleaning device as provided by an embodiment of the present invention.

FIG. 6 is a schematic view illustrating a driving principle of another type of driving system in a substrate cleaning device which, for example, may be used for replacing the driving system in the substrate cleaning devices as provided by embodiments shown in FIG. 4 and FIG. 5.

Referring to FIG. 6, the transmission mechanism 42 that drives a plurality of transmission gears 3 to rotate reciprocally comprises: a cam 5, a sliding rail 426 and a pushing bar 427 that form a cam link mechanism; and a transform mechanism cam 5 that is fitted at the output shaft of the drive motor 41 and configured to connect the pushing bar 427 with one transmission gear 3 of each of the gear sets 32 and to transform the linear motion of the pushing bar 427 into the circumferential motion of the transmission gear 3; the sliding rail 426 is fixed relative to the housing and extending along the moving direction a of the substrate 1; the pushing bar 427 is slidable mounted at and fitted with the sliding rail 426, and one end of the pushing bar 427 is mounted at and fitted with the cam 5.

The output shaft of the drive motor 41 is equipped with a cam 5 having a guiding slot 51; the pushing bar 427 is slidably disposed in the sliding rail 426, and one end of the pushing bar 427 is fitted in the guiding slot 51 of the cam 5 through a roller so that the cam 5, the pushing bar 427 and the sliding rail 426 form a cam link mechanism. The drive motor 41 drives the pushing bar 427, through the cam link mechanism, to make linear motion reciprocally in the sliding rail 426; the pushing bar 427 drives one transmission gear 321 of the gear set 32, through the transform mechanism, to rotate axially and reciprocally; and meanwhile one transmission gear 321 drives another transmission gear 322 engaged therewith to rotate axially and reciprocally, with the transmission gear 321 and the transmission gear 322 rotating reciprocally in opposite directions, thereby transforming the linear motion of the pushing bar 427 into the circumferential motion of the plurality of transmission gears 3.

Referring to FIG. 4 again, the transform mechanism of the substrate cleaning device according to the second embodiment comprises: a sliding chute 428 that is disposed on the pushing bar 427 and perpendicular to the substrate; a sliding bar 429 having one end fixed to one transmission gear 321 of the gear set 32 and the other end extending into the sliding chute 428. Since one end of the sliding bar 429 is fixed at one transmission gear 321 of the gear set 32 such that the moving direction of the sliding bar 429 has to be consistent with the rotation direction of the transmission gear 321 and since the other end of the sliding bar 429 extends into the sliding chute 428, the sliding bar 429 further makes up-down motion reciprocally in the sliding chute 428 of the pushing bar 427 with respect to the pushing bar 427 while the pushing bar 427 drives the sliding bar 429 to make reciprocal motion along a moving direction of the pushing bar 427, thereby transforming the linear motion of the pushing bar 427 into the circumferential motion of the transmission gear 321.

Referring to FIG. 5, the third embodiment differs from the second embodiment in the transform mechanism of the substrate cleaning device. The transform mechanism of the substrate cleaning device according to the third embodiment comprises a rack 6 which is disposed at a side of the pushing bar 427 facing towards the transmission gear 3 and engages with one transmission gear 321 of each of the gear sets 32. The rack 6 engaged with the transmission gear 321 constitutes a transform mechanism; the pushing bar 427, through the rack 6, drives the transmission gear 321 of each of the gear sets 32 that is engaged with the rack 6 to rotate axially and reciprocally, thereby transforming the linear motion of the pushing bar 427 into the circumferential motion of the plurality of transmission gears 3.

Referring to FIG. 7, in the fourth embodiment, a plurality of transmission gears 3 form several gear sets 32 each comprising two transmission gears engaged with each other; as shown in FIG. 7, gears 321 and 322 in the gear set 32 engage with each other; the transmission mechanism 42 comprises: a driving wheel 421, a connecting rod 422 and a pushing bar 427; as well as a transform mechanism which connects the pushing bar 427 with one transmission gear of each of the gear sets 32 and transforms the linear motion of the pushing bar 427 into the circumferential motion of the transmission gear 3. The driving wheel 421 is coaxially fixed at the output shaft of the drive motor 41; one end of the connecting rod 422 is hinged with the driving wheel 421, and the other end of the connecting rod 422 is hinged with one end of the pushing bar 427.

The transform mechanism in this embodiment comprises: a circular hole formed in the pushing bar 427; and a sliding bar 429 having one end fixed at one transmission gear 321 in the gear set 32 and the other end inserted into the circular hole of the pushing bar 427 and rotatably fitted with the circular hole.

Two ends of the connecting rod 422 2, respectively, are rotatably connected with one pin shaft perpendicular to the connecting rod 42, and the pin shaft at one end of the connecting rod 422 is fixed onto the driving wheel 421 and the pin shaft at the other end of the connecting rod 422 is fixed at one end of the pushing bar 427 so that the connecting rod 422 is hinged between the driving wheel 421 and the pushing bar 427; the sliding bar 429 fixed with the transmission gear 321 is inserted into the circular hole of the pushing bar 427 to constitute a transform mechanism. The drive motor 41, through the driving wheel 421 and the connecting rod 422, pushes the pushing bar 427 to make reciprocal motion; and the pushing bar 427, while making reciprocal motion, drives one transmission gear 321 of the gear set 32 to rotate axially and reciprocally; since the transmission gear 321 and the transmission gear 322 in the same gear set 32 engage with each other, they rotate reciprocally at the same frequency together in opposite directions, thereby transforming the linear motion of the pushing bar 427 into the circumferential motion of the transmission gear 321.

Referring to FIG. 2, in the embodiment of the present invention, each of the spray pipelines 2 is provided with several spray nozzles 7 spaced at a certain distance which form the spray ports 21; the spray ports 21 on adjacent spray pipelines 2 are arranged to be opposite to each other or offset from each other. The spray nozzles 7 are disposed on the spray pipeline 2 by threaded connection or soldering or other connecting manners, with each of the spray nozzles 7 forming one spray port 21.

It is understood that the described above are just exemplary implementations and embodiments to explain the principle of the present invention and the invention is not intended to limit thereto. An ordinary person in the art can make various variations and modifications to the present invention without departure from the spirit and the scope of the present invention, and such variations and modifications shall fall in the scope of the present invention.

What is claimed is:

1. A substrate cleaning device, comprising:

a housing having a cleaning chamber therein;

a first plurality of spray pipelines and a second plurality of spray pipelines, wherein each of the spray pipelines is pivotally mounted at the housing and distributed side by side along a moving direction of a substrate, wherein each of the spray pipelines is pivotally rotatable about a respective longitudinal axis, and the longitudinal axis of each of the spray pipelines is perpendicular to the moving direction of the substrate, and each of the spray pipelines is provided with several spray ports configured to direct liquid in the spray pipeline towards a surface to be cleaned of the substrate, and one end of each of the spray pipelines is provided with a transmission gear coaxially fixed thereto, and each of the spray pipelines extends the entire width of the substrate and extends from one side of the substrate to the other side of the substrate;

a driving system coupled with the transmission gear and thus configured to drive the spray pipelines, through the transmission gear, to rotate reciprocally at a same frequency, wherein the first plurality of spray pipelines have a reciprocal rotation direction opposite to that of the second plurality of spray pipelines, wherein the first plurality of the spray pipelines has a same number of spray pipelines as the second plurality of the spray pipeline.

2. The substrate cleaning device according to claim 1, wherein the driving system comprises:

a drive motor mounted at the housing; and a transmission mechanism configured to drive a plurality of transmission gears to rotate axially and reciprocally, a power input end of the transmission mechanism is transmissively coupled with an output shaft of the drive motor.

3. The substrate cleaning device according to claim 2, wherein the transmission mechanism comprises:

a driving wheel coaxially fixed to the output shaft of the drive motor;

a connecting rod having one end hinged with the driving wheel;

a transition gear hinged with the other end of the connecting rod, wherein the driving wheel, the connecting rod and the transition gear form a four-bar mechanism;

a conveyer belt connected with the plurality of transmission gears and the transition gear; and at least one tensioning pulley configured to tension the conveyer belt.

4. The substrate cleaning device according to claim 3, wherein the plurality of transmission gears form several gear sets which are adjacent to each other successively, and the conveyer belts on the transmission gears in any adjacent two gear sets are winded in opposite directions.

5. The substrate cleaning device according to claim 4, wherein each of the gear sets comprises at least one transmission gear.

6. The substrate cleaning device according to claim 2, wherein the plurality of transmission gears form several gear sets each comprising two transmission gears engaged with each other.

7. The substrate cleaning device according to claim 6, wherein the transmission mechanism comprises:

a driving wheel, a connecting rod, a sliding rail and a pushing bar that form a crank slider mechanism; and a transform mechanism configured to connect the pushing bar with one transmission gear of each of the gear sets and transform a linear motion of the pushing bar into a circumferential motion of the transmission gear; wherein, the driving wheel is coaxially fixed with the output shaft of the drive motor;

one end of the connecting rod is hinged with the driving wheel, and the other end of the connecting rod is hinged with one end of the pushing bar;

the sliding rail is fixed relative to the housing and extending along the moving direction of the substrate;

the pushing bar is slidably mounted at and fitted with the sliding rail.

8. The substrate cleaning device according to claim 6, wherein the transmission mechanism comprises:

a cam, a sliding rail and a pushing bar that form a cam link mechanism, and a transform mechanism configured to connect the pushing bar with one transmission gear of each of the gear sets and transform a linear motion of the pushing bar into a circumferential motion of the transmission gear; wherein, the cam is fitted at the output shaft of the drive motor;

the sliding rail is fixed relative to the housing and extending along the moving direction of the substrate;

the pushing bar is slidably mounted at and fitted with the sliding rail, and one end of the pushing bar is mounted at and fitted with the cam.

9. The substrate cleaning device according to claim 7, wherein the transform mechanism comprises:

a sliding chute that is disposed on the pushing bar and perpendicular to the substrate; and a sliding bar having one end fixed at one transmission gear in the gear set and the other end extending into the sliding chute.

10. The substrate cleaning device according to claim 7, wherein the transform mechanism comprises:

a rack that is disposed at a side of the pushing bar facing towards the transmission gear and engaged with one transmission gear in each of the gear sets.

11. The substrate cleaning device according to claim 6, wherein the transmission mechanism comprises:

a driving wheel, a connecting rod and a pushing bar, and a transform mechanism configured to connect the pushing bar with one transmission gear of each of the gear sets and transform a linear motion of the pushing bar into a circumferential motion of the transmission gear; wherein, the driving wheel is coaxially fixed at the output shaft of the drive motor;

one end of the connecting rod is hinged with the driving wheel, and the other end of the connecting rod is hinged with one end of the pushing bar.

12. The substrate cleaning device according to claim 11, wherein the transform mechanism comprises:

a circular hole disposed in the pushing bar;

a sliding bar having one end fixed at one transmission gear of the gear set and the other end inserted into the circular hole of the pushing bar and rotatably fitted with the circular hole.

13. The substrate cleaning device according to claim 1, wherein each of the spray pipelines is provided with several spray nozzles spaced in a certain distance which form the spray ports.

14. The substrate cleaning device according to claim 1, wherein the portion of the plurality of the spray pipelines has a same number of spray pipelines as the other portion of the plurality of the spray pipelines.

15. The substrate cleaning device according to claim 8, wherein the transform mechanism comprises:

a sliding chute that is disposed on the pushing bar and perpendicular to the substrate; and a sliding bar having one end fixed at one transmission gear in the gear set and the other end extending into the sliding chute.

16. The substrate cleaning device according to claim 8, wherein the transform mechanism comprises:

a rack that is disposed at a side of the pushing bar facing towards the transmission gear and engaged with one transmission gear in each of the gear sets.

17. The substrate cleaning device according to claim 2, wherein each of the spray pipelines is provided with several spray nozzles spaced in a certain distance which form the spray ports.

* * * * *